US011002154B2

(12) United States Patent
Sandor et al.

(10) Patent No.: US 11,002,154 B2
(45) Date of Patent: May 11, 2021

(54) TURBOCHARGER FOR AN INTERNAL COMBUSTION ENGINE, AND TURBINE HOUSING

(71) Applicant: CPT Group GMBH, Hannover (DE)

(72) Inventors: Ivo Sandor, Regensburg (DE); Sebastian Wittwer, Erfurt (DE); Michael Klaus, Tegernheim (DE); Ralf Böning, Reiffelbach (DE)

(73) Assignee: Vitesco Technologies GMBH, Hannover (DE)

( * ) Notice: Subject to any disclaimer, the term of this patent is extended or adjusted under 35 U.S.C. 154(b) by 65 days.

(21) Appl. No.: 16/564,458

(22) Filed: Sep. 9, 2019

(65) Prior Publication Data

US 2020/0003079 A1 Jan. 2, 2020

Related U.S. Application Data

(63) Continuation of application No. PCT/EP2018/057247, filed on Mar. 22, 2018.

(30) Foreign Application Priority Data

Mar. 30, 2017 (DE) ..... 10 2017 205 457.3

(51) Int. Cl.
*F01D 9/02* (2006.01)
*F01D 25/28* (2006.01)

(52) U.S. Cl.
CPC ..... *F01D 25/28* (2013.01); *F05D 2220/40* (2013.01); *F05D 2240/24* (2013.01); *F05D 2240/54* (2013.01)

(58) Field of Classification Search
CPC ..... F01D 9/26; F01D 5/048; F01D 21/045; F01D 21/04; F05D 2240/24; F05D 2240/54; F05D 2220/40; F02C 6/12
See application file for complete search history.

(56) References Cited

U.S. PATENT DOCUMENTS 6,767,185 B2 * 7/2004 Martin ..... F01D 9/026 415/205
2004/0071550 A1 4/2004 Martin et al.
(Continued)

FOREIGN PATENT DOCUMENTS

DE 102013223873 A1 5/2015
DE 102016004770 A1 11/2016
(Continued)

OTHER PUBLICATIONS

Logan, Earl et al., Handbook of Turbomachinery, Marcel Dekker, Inc., pp. 411-426, 2003.
(Continued)

*Primary Examiner* — Courtney D Heinle
*Assistant Examiner* — Maxime M Adjagbe

(57) ABSTRACT

Example embodiments relate to a turbocharger for a combustion machine, having a bearing housing, in which a rotor shaft is mounted so as to be rotatable about a rotor axis of rotation. An exhaust-gas turbine with a turbine wheel is arranged rotationally conjointly on the rotor shaft and which has an impeller blade arrangement with multiple turbine blades, and with a turbine housing is mechanically fixed to the bearing housing and which surrounds the turbine wheel With respect to a meridional view of the exhaust-gas turbine, the turbine housing and the turbine wheel are designed and adapted to one another such that the following condition is satisfied:

$$\frac{L_{cover}}{L_{axTip}} > 1 - \frac{Tip_{clr}}{R_{in}} \times \frac{3\pi}{4} \times \frac{1}{\left(1 - \frac{R_{out}}{R_{in}}\right)}.$$

19 Claims, 4 Drawing Sheets

(56) References Cited

U.S. PATENT DOCUMENTS

| | | | | |
|---|---|---|---|---|
| 2015/0345316 | A1* | 12/2015 | Henderson | F01D 9/026 415/204 |
| 2016/0186568 | A1* | 6/2016 | Faeth | F01D 25/12 415/170.1 |
| 2016/0341072 | A1* | 11/2016 | Chandramohanan | F02C 7/24 |

FOREIGN PATENT DOCUMENTS

| | | | |
|---|---|---|---|
| EP | 3144541 | A1 | 3/2017 |
| WO | 2005119030 | A1 | 12/2005 |
| WO | 2011002732 | A2 | 1/2011 |

OTHER PUBLICATIONS

International Search Report and Written Opinion dated Jul. 2, 2018 from corresponding International Patent Application No. PCT/EP2018/057247.

German Search Report dated Jan. 1, 2018 for corresponding German Patent Application No. 10 2017 205 457.3.

* cited by examiner $$\frac{L_{cover}}{L_{axTip}} > 1 - \frac{Tip_{clr}}{R_{in}} \cdot \frac{3\pi}{4} \cdot \frac{1}{(1-Trim)}$$

TURBOCHARGER FOR AN INTERNAL COMBUSTION ENGINE, AND TURBINE HOUSING

CROSS-REFERENCE TO RELATED APPLICATIONS

This application claims the benefit of PCT Application PCT/EP2018/057247, filed Mar. 22, 2018, which claims priority to German Application DE 10 2017 205 457.3, filed Mar. 30, 2017. The above applications are incorporated herein by reference in their entirety.

FIELD OF INVENTION

The invention relates to a turbocharger for a combustion machine.

BACKGROUND

Exhaust-gas turbochargers are increasingly being used to increase power in motor vehicle internal combustion engines. More and more frequently, this is done with the aim of reducing the overall size and weight of the internal combustion engine for the same power or even increased power and, at the same time, of reducing consumption and thus $CO_2$ emissions, with regard to ever stricter legal requirements in this respect. The principle of action consists in using the energy contained in the exhaust-gas flow to increase a pressure in an intake tract of the internal combustion engine and thus to bring about better filling of a combustion chamber of the internal combustion engine with atmospheric oxygen. In this way, more fuel, such as gasoline or diesel, can be converted in each combustion process, i.e. the power of the internal combustion engine can be increased.

To this end, the exhaust-gas turbocharger has an exhaust-gas turbine arranged in the exhaust tract of the internal combustion engine, a fresh-air compressor arranged in the intake tract and a rotor bearing arranged therebetween. The exhaust-gas turbine has a turbine housing and a turbine impeller arranged therein, which is driven by the exhaust-gas mass flow. The fresh-air compressor has a compressor housing and a compressor impeller arranged therein, which builds up a boost pressure. The turbine impeller and the compressor impeller are arranged for conjoint rotation on the opposite ends of a common shaft, referred to as the rotor shaft, and thus form what is referred to as the turbocharger rotor. The rotor shaft extends axially between the turbine impeller and compressor impeller through the rotor bearing arranged between the exhaust-gas turbine and fresh-air compressor, and is rotatably mounted in said rotor bearing in the radial and axial directions in relation to the rotor shaft axis. According to this construction, the turbine impeller driven by the exhaust-gas mass flow drives the compressor impeller via the rotor shaft, thereby increasing the pressure in the intake tract of the internal combustion engine in relation to the fresh-air mass flow behind the fresh-air compressor, and thereby ensuring better filling of the combustion chamber with atmospheric oxygen.

SUMMARY

One object is to specify a concept for a turbocharger which contributes to reliable operation of a turbocharger.

A turbocharger for a combustion machine is disclosed. The turbocharger has a bearing housing in which a rotor shaft is mounted so as to be rotatable about a rotor axis of rotation, wherein the rotor shaft is mounted in the bearing housing by means of at least two radial bearings. The turbocharger has an exhaust-gas turbine with a turbine wheel which is arranged rotationally conjointly on the rotor shaft and which has an impeller blade arrangement with multiple turbine blades, and with a turbine housing which is mechanically fixed to the bearing housing and which surrounds the turbine wheel. With respect to a meridional view of the exhaust-gas turbine, the following applies:

a. At least one turbine blade of the turbine wheel has a flow inlet edge and a flow outlet edge for the exhaust-gas mass flow.
b. The flow inlet edge has a maximum inlet radius $R_{in}$ and the flow outlet edge has a maximum outlet radius $R_{out}$, in each case with respect to the rotor axis of rotation.
c. The at least one turbine blade has an outer contour which faces toward the turbine housing and which extends from the flow inlet edge to the flow outlet edge and which has an axial extent length $L_{axTip}$.
d. The turbine housing has a housing contour which is situated opposite the outer contour.
e. The outer contour of the at least one turbine blade has an axial length segment $L_{cover}$ of the axial extent $L_{axTip}$ in which the at least one turbine blade is axially covered by the turbine housing.
f. A smallest radial distance $Tip_{clr}$ with respect to the rotor axis of rotation is formed between the housing contour and the outer contour.

The turbine housing and the turbine wheel are designed and adapted to one another such that the following condition or equation is satisfied:

$$\frac{L_{cover}}{L_{axTip}} > 1 - \frac{Tip_{clr}}{R_{in}} \times \frac{3\pi}{4} \times \frac{1}{\left(1 - \frac{R_{out}}{R_{in}}\right)}.$$

It has been recognized that turbocharger damage may occur during the operation of the turbocharger, for example during test stand running for the design of the turbocharger or of components of the turbocharger such as the rotor. For example, a component failure of the rotor shaft or of the impellers, for example a shaft breakage, may occur.

In the case of a shaft breakage of the rotor shaft, the turbine wheel can for example no longer be held axially in its intended position by an axial bearing. In this case, the turbine wheel would be moved predominantly by aerodynamic forces, for example owing to prevailing gas pressures, in the direction of a turbine housing outlet for the exhaust-gas mass flow. Here, that portion of the turbine blades of the turbine wheel which has a diameter larger than an outlet diameter of the turbine housing at the downstream end of the turbine wheel abuts against the turbine housing and obstructs the turbine wheel in its axial movement in the direction of the turbine housing outlet. It has furthermore been recognized that, if this portion of turbine wheel blades is not sufficiently large, the turbine blades will, in the event of a shaft breakage, be plastically deformed such that the turbine wheel may perform a further, undesired axial displacement.

A disadvantage in such a case would be, inter alia, that piston rings of oil seals could depart from their original axial position and a sealing action would thus be lost. This would have inter alia the negative consequence that oil could escape in such quantities that the internal combustion engine, into the oil circuit of which the turbocharger is coupled, must be shut down immediately in order to prevent damage. However, an escape of oil should be imperatively or substantially prevented in order to ensure at least emergency running properties of the system. It has furthermore been recognized that a shaft breakage between the oil seals, such as the piston rings of both seals, is disadvantageous because, in addition to the impellers and the shaft stubs remaining thereon, the seals could also leave the turbocharger, which would further promote the adverse oil loss described.

The described turbocharger provides that the turbine wheel and turbine housing are designed and arranged in accordance with the condition (equation) formulated above. The condition specifies that a contour profile of the turbine housing and/or the at least one turbine wheel blade are specifically redesigned in relation to known turbines. In particular, a length segment ($L_{cover}$) of the turbine wheel blade which is axially covered by the housing is increased such that, in the event of a shaft fracture, a greater portion of the turbine wheel blades would be plastically deformed in the event of an axial displacement, so that a further axial movement of the turbine wheel with respect the rotor axis of rotation is obstructed or limited. For example, proceeding from a conventional housing contour in the region of the turbine wheel, by means of the redesign alone, that length segment of the turbine wheel blade which is axially covered by the housing is increased. In other words, the condition defines a minimum value of that length segment of the turbine wheel blade which is axially covered.

Such a design based on the given equation contributes to the fact that the turbine wheel, after a shaft breakage, that is to say in the event of damage to the turbocharger, provides greater resistance to further axial displacement in the event of collision with the housing. The equation thus allows for optimal design of the turbine wheel and turbine housing on the basis of various parameters. Depending on the boundary conditions for the turbocharger, such as intended purpose, intended use or others, certain parameters of the same may be predefined, wherein one or more remaining parameters can be ascertained by means of the equation. An expedient coordination of the parameters can thus always be achieved in accordance with the boundary conditions. In particular, it is possible by means of the equation to easily determine the axial overlap length $L_{cover}$ necessary for the above advantages and functions.

A turbocharger designed in accordance with the conditions contributes to the avoidance of the disadvantages mentioned above in the event of damage, in particular the aforementioned shaft breakage, in particular if the turbine wheel is then mounted only radially. Here, it is not imperatively necessary for a rear disk and/or the turbine wheel blades to be structurally reinforced. In other words, owing to the above condition, it is not necessary to correspondingly thicken the turbine wheel blades. Also, owing to the above condition, it is not necessary to provide a low trim ratio, that is to say a ratio between the maximum outlet radius $R_{out}$ and the maximum inlet radius $R_{in}$. In this way, it is possible inter alia for material costs to be saved. Both such measures would be disadvantageous with regard to the performance of the turbocharger, for example owing to higher inertia.

Meridional view means for example a planar, two-dimensional view in which an outermost contour of the turbine wheel is illustrated, which the turbine wheel describes during a rotation about the rotor axis of rotation, which also corresponds to an axis of rotation of the turbine wheel. The view may also relate to or include at least parts of the turbine housing, wherein, in particular, in the region of the turbine wheel, an inner contour with a smallest radius in relation to the axis of rotation is illustrated, which the turbine housing would describe during a rotation about the axis of rotation.

That housing contour of the turbine housing (shroud) which is situated opposite the outer contour is formed correspondingly to the outer contour. The smallest radial distance $Tip_{clr}$ with respect to the rotor axis of rotation may be a distance that is constant over the entire axial region between the inlet edge and the outlet edge. However, it is also conceivable that the distance is present only in certain portions, in a single region or point with respect to the axis of rotation.

The axial length segment means that axial extent of the outer contour in which a radius or a diameter of the turbine wheel with respect to the rotor axis of rotation is greater than a minimum diameter/radius of the turbine housing in the region of a downstream end of the turbine wheel. In other words, in this region, the diameter of the turbine wheel is greater than a smallest diameter of the turbine housing. In other words, this is that axial region of a turbine wheel which, if one were to project the turbine wheel and the turbine housing into a plane normal to the rotor axis of rotation, is covered or overlapped by the turbine housing. In other words, this is that region which lies in the shadow of the turbine housing in relation to the rotor axis of rotation. In other words, the outer contour of the at least one blade has an axial overlap portion which has the axial length segment $L_{cover}$ of the axial extent $L_{axTip}$.

The following embodiments all contribute to the above advantages and functions, wherein the above condition is advantageously further developed through the specification of one or more limit values.

According to one embodiment, for the ratio $Tip_{clr}$ to $R_{in}$, the following applies:

$$\frac{Tip_{clr}}{R_{in}} \leq 2.5\%.$$

According to one embodiment, for the ratio $Tip_{clr}$ to $R_{in}$, the following applies:

$$\frac{Tip_{clr}}{R_{in}} \leq 2.0\%.$$

According to one embodiment, for the ratio $Tip_{clr}$ to $R_{in}$, the following applies:

$$\frac{Tip_{clr}}{R_{in}} \leq 1.5\%.$$

According to one embodiment, for the ratio $L_{cover}$ to $L_{axtip}$, the following applies:

$$\frac{L_{cover}}{L_{axTip}} > 0.2.$$

According to one embodiment, for the ratio $L_{cover}$ to $L_{axtip}$, the following applies:

$$\frac{L_{cover}}{L_{axTip}} > 0.25.$$

According to one embodiment, for the ratio $L_{cover}$ to $L_{axtip}$, the following applies:

$$\frac{L_{cover}}{L_{axTip}} > 0.3.$$

According to one embodiment, for the ratio $R_{out}$ to $R_{in}$, the following applies:

$$\frac{R_{out}}{R_{in}} > 0.8.$$

According to one embodiment, for the ratio $R_{out}$ to $R_{in}$, the following applies:

$$\frac{R_{out}}{R_{in}} < 0.95.$$

According to one embodiment, for the ratio $R_{out}$ to $R_{in}$, the following applies:

$$\frac{R_{out}}{R_{in}} < 0.93.$$

According to one embodiment, for the ratio $R_{out}$ to $R_{in}$, the following applies:

$$\frac{R_{out}}{R_{in}} < 0.92.$$

According to one embodiment, for the ratio $R_{out}$ to $R_{in}$, the following applies:

$$\frac{R_{out}}{R_{in}} < 0.91.$$

According to one embodiment, for the ratio $R_{out}$ to $R_{in}$, the following applies:

$$\frac{R_{out}}{R_{in}} < 0.90.$$

The ratio $R_{out}$ to $R_{in}$ is also referred to as trim or trim ratio.

In embodiments, the trim ratio lies between 0.8 and one of the other above-stated limits.

Also disclosed is a turbine wheel for an exhaust-gas turbocharger according to one of the above embodiments. The turbine wheel has an impeller blade arrangement with multiple turbine blades. The turbine wheel is designed such that the following condition is satisfied:

$$\frac{L_{cover}}{L_{axTip}} > 1 - \frac{Tip_{cir}}{R_{in}} \times \frac{3\pi}{4} \times \frac{1}{\left(1 - \frac{R_{out}}{R_{in}}\right)}$$

Here, with respect to a meridional view of the turbine wheel, the following applies:

a. at least one turbine blade of the turbine wheel has a flow inlet edge and a flow outlet edge for the exhaust-gas mass flow;

b. $R_{in}$ describes a maximum inlet radius of the flow inlet edge and $R_{out}$ describes a maximum outlet radius of the flow outlet edge, in each case with respect to an axis of rotation of the turbine wheel;

c. $L_{axTip}$ describes an axial extent length of an outer contour of the at least one turbine blade, wherein the outer contour extends from the flow inlet edge to the flow outlet edge and, during intended operation, faces toward a surrounding turbine housing;

d. $L_{cover}$ describes an axial length segment of the axial extent $L_{axTip}$ of the outer contour in which the turbine blade is axially covered by the turbine housing;

e. $Tip_{clr}$ describes a smallest radial distance between a housing contour, which during intended operation is situated opposite the outer contour, of the turbine housing and the outer contour with respect to the rotor axis of rotation.

The above statements apply analogously.

The turbine wheel permits the above-stated advantages and functions.

Also disclosed is a method for producing a turbocharger according to any of the preceding embodiments. The method includes the steps of:

a. ascertaining and/or determining the parameters of the maximum inlet radius $R_{in}$, the maximum outlet radius $R_{out}$, the axial extent length $L_{axTip}$, the axial length segment $L_{cover}$ and the smallest radial distance $Tip_{clr}$, such that, for the turbine wheel and the turbine housing, the following condition is satisfied:

$$\frac{L_{cover}}{L_{axTip}} > 1 - \frac{Tip_{cir}}{R_{in}} \times \frac{3\pi}{4} \times \frac{1}{\left(1 - \frac{R_{out}}{R_{in}}\right)},$$

and b. manufacturing the turbine wheel and the turbine housing on the basis of the parameters ascertained by means of the condition.

The above statements apply analogously.

The method permits the above-stated advantages and functions.

Example embodiments of the invention will be described below, without restricting the general nature.

BRIEF DESCRIPTION OF THE DRAWINGS

The exemplary embodiments will be described below with the aid of the appended figures. Identical elements or elements of identical action are denoted by the same reference designations throughout the figures.

In the figures.

DETAILED DESCRIPTION

Figure 1:
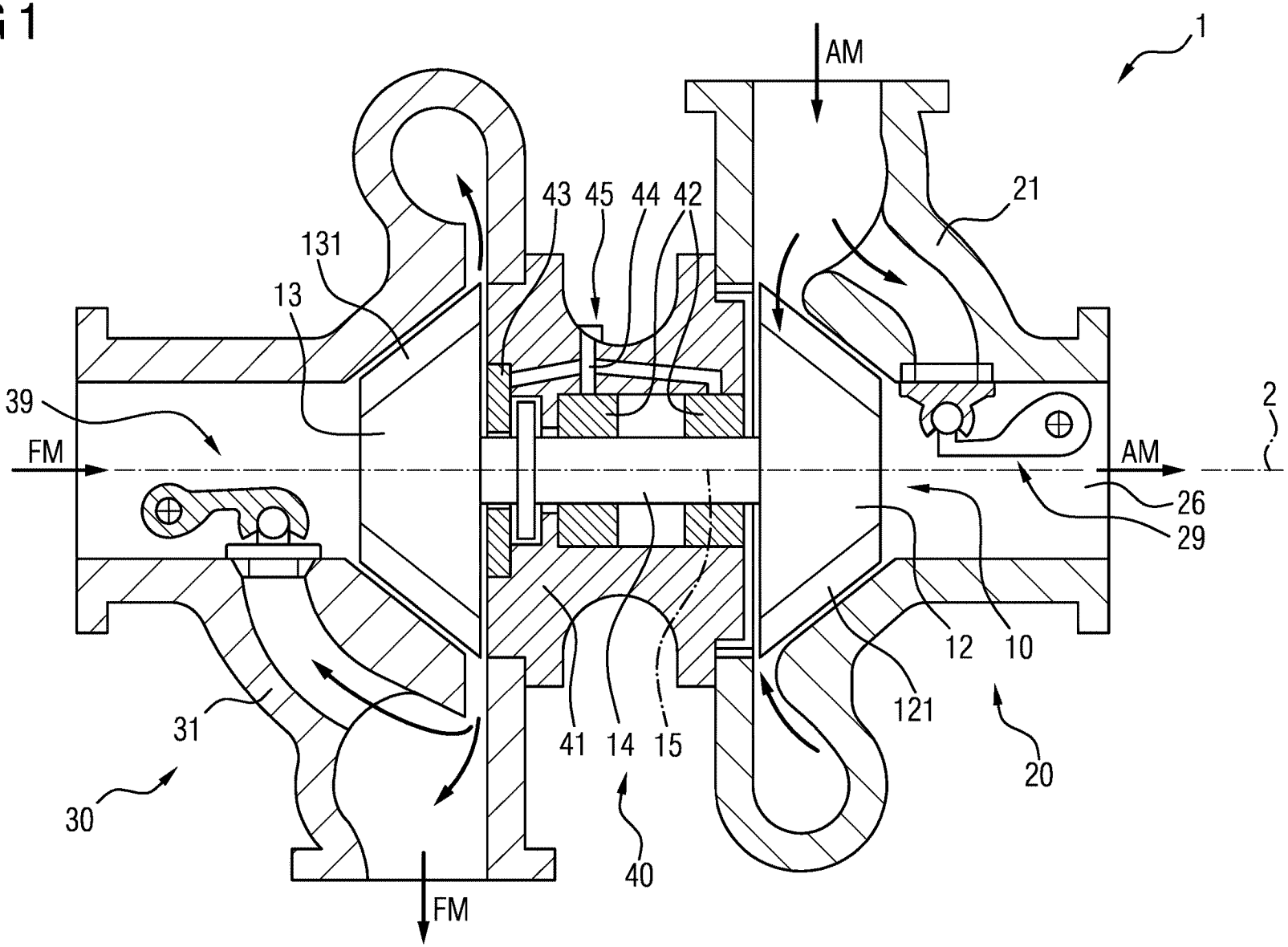
FIG. 1 shows a schematic sectional view of a turbocharger.

FIG. 1 schematically shows a sectional illustration of an example of an exhaust-gas turbocharger 1, which has an exhaust-gas turbine 20, a fresh-air compressor 30 and a rotor bearing 40. The exhaust-gas turbine 20 is equipped with a wastegate valve 29 and an exhaust-gas mass flow AM is indicated by arrows. The fresh-air compressor 30 has an overrun air recirculation valve 39 and a fresh-air mass flow FM is likewise indicated by arrows. A turbocharger rotor 10, as it is known, of the exhaust-gas turbocharger 1 has a turbine impeller 12 (also referred to as turbine wheel), a compressor impeller 13 (also referred to as compressor wheel) and a rotor shaft 14 (also referred to as shaft). The turbocharger rotor 10 rotates about a rotor axis of rotation 15 of the rotor shaft 14 during operation. The rotor axis of rotation 15 and at the same time the turbocharger axis 2 (also referred to as longitudinal axis) are illustrated by the indicated center line and identify the axial orientation of the exhaust-gas turbocharger 1.

In general, a conventional exhaust-gas turbocharger 1, as illustrated in FIG. 1, has a multi-part construction. Here, a turbine housing 21 that is arrangeable in the exhaust tract of the internal combustion engine, a compressor housing 31 that is arrangeable in the intake tract of the internal combustion engine, and, between the turbine housing 21 and compressor housing 31, a bearing housing 41 are arranged alongside one another with respect to the common turbocharger axis 2 and connected together in terms of assembly.

The bearing housing 41 is arranged axially between the turbine housing 21 and the compressor housing 31. The rotor shaft 14 of the turbocharger rotor 10 and the required bearing arrangement for the axial mounting and for the radial mounting of the rotor shaft 14 are accommodated in the bearing housing 41.

A further structural unit of the exhaust-gas turbocharger 1 is represented by the turbocharger rotor 10, which has the rotor shaft 14, the turbine impeller 12, which is arranged in the turbine housing 21 and which has an impeller blade arrangement 121, and the compressor impeller 13, which is arranged in the compressor housing 31 and which has an impeller blade arrangement 131. In other words, the turbine wheel 12 and the compressor wheel 13 have multiple blades, which are arranged on a corresponding hub. The turbine impeller 12 and the compressor impeller 13 are arranged on the opposite ends of the common rotor shaft 14 and connected for conjoint rotation thereto. The rotor shaft 14 extends in the direction of the turbocharger axis 2 axially through the bearing housing 41 and is mounted axially and radially therein so as to be rotatable about its longitudinal axis, the rotor axis of rotation 15, wherein the rotor axis of rotation 15 coincides with the turbocharger axis 2. The turbocharger rotor 10 is supported with its rotor shaft 14 by means of two radial bearings 42 and one axial bearing disk 43. Both the radial bearings 42 and the axial bearing disk 43 are supplied with lubricant via oil supply channels 44 of an oil connection 45.

The turbine housing 21 has one or more exhaust-gas annular ducts, referred to as exhaust-gas channels 22, that are arranged annularly around the turbocharger axis 2 and the turbine impeller 12 and narrow helically toward the turbine impeller 12. These exhaust-gas channels 22 each have their own or a common exhaust-gas feed duct 23, directed tangentially outward, with a manifold connection branch 24 for connecting to an exhaust-gas manifold (not illustrated) of an internal combustion engine, through which the exhaust-gas mass flow AM flows into the particular exhaust-gas channel 22 and then onto the turbine impeller 12. The turbine housing 21 furthermore has an exhaust-gas discharge duct 26, which extends away from the axial end of the turbine impeller 12 in the direction of the turbocharger axis 2 and has an exhaust connection branch 27 for connecting to the exhaust system (not illustrated) of the internal combustion engine. Via this exhaust-gas discharge duct 26, the exhaust-gas mass flow AM emerging from the turbine impeller 12 is discharged into the exhaust system of the internal combustion engine.

Further details of the turbocharger 1 will not be discussed at this juncture. It is pointed out that the turbocharger 1 described in FIG. 1 is to be understood as an example and may alternatively also have other configurations, without this giving rise to restrictions for the following description of example embodiments of the invention on the basis of FIGS. 4 to 6.

Figure 2:
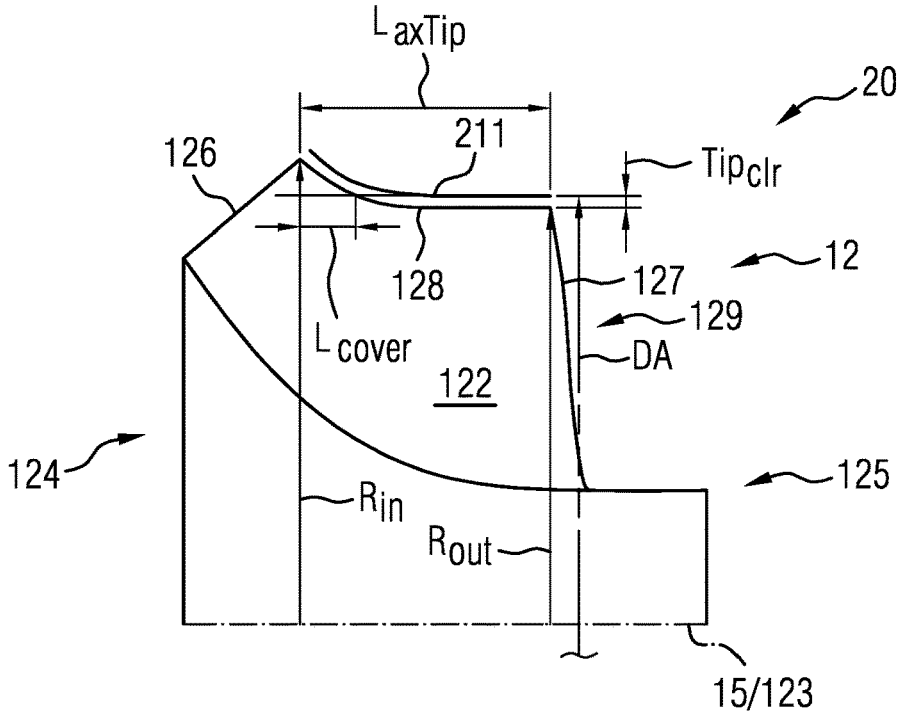
FIGS. 2 and 3 show two schematic sectional views of exhaust-gas turbines of a turbocharger.
Figure 3:
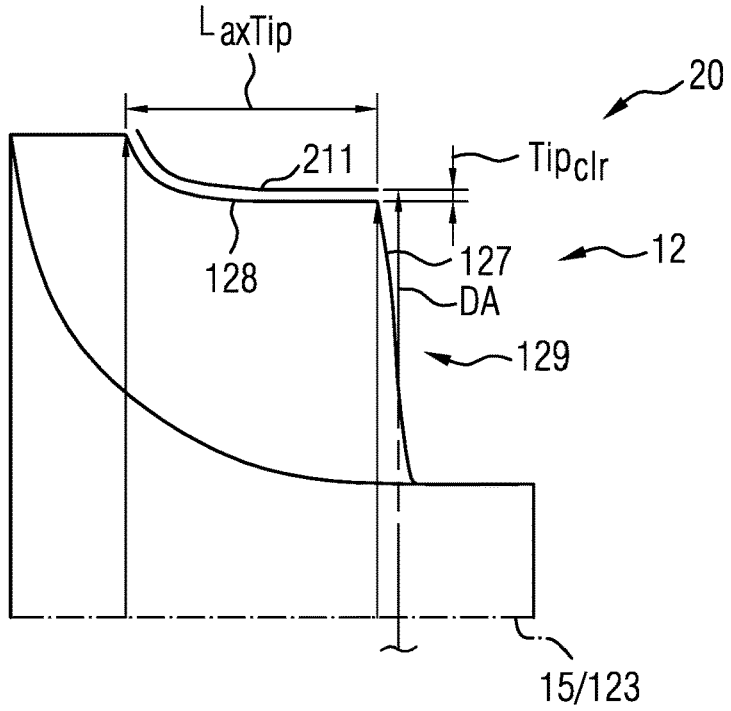

FIGS. 2 and 3 show, in each case in a meridional view, exhaust-gas turbines 20 of a turbocharger 1, which exhaust-gas turbines each have a turbine housing 21 and a turbine wheel 12 with multiple turbine blades 122. FIG. 2 illustrates a radial-axial turbine wheel, and FIG. 3 illustrates a radial turbine wheel, in a schematic half section. The rotor axis of rotation 15, which corresponds to an axis of rotation 123 of the turbine wheel 12, is shown in each case. In the illustrations of FIGS. 2 and 3, in each case one of multiple turbine blades 122 is illustrated, which turbine blades are typically arranged on the hub of the turbine wheel 12.

The turbines 20 of the two FIGS. 2 and 3 will be described by way of example on the basis of FIG. 2.

The turbine wheel 12 has an upstream axial end 124 and a downstream axial end 125. As can be seen in the meridional view, the illustrated turbine blade 122, like all of the other turbine blades, has a flow inlet edge 126 for the exhaust-gas mass flow AM and a flow outlet edge 127 for the exhaust-gas mass flow AM downstream of the outlet from the turbine wheel 12 or from the turbine blades 122. The flow inlet edge 126 and/or the flow outlet edge 127 may run obliquely or otherwise, for example parallel, with respect to the rotor axis of rotation 15, as can be seen from FIGS. 2 and 3. The flow inlet edge 126 and the flow outlet edge 127 are connected via an outer contour 128 (tip). The outer contour 128 lies directly opposite a housing contour 211 of the turbine housing 21, which surrounds the turbine wheel 12. The housing contour 211 is formed correspondingly to the outer contour 128, wherein a profile of the two contours 128 and 211 in the view shown runs substantially mutually parallel with respect to the rotation axis 123. The further turbine housing 21 is not illustrated for the sake of clarity.

It has been recognized that the illustrated exhaust-gas turbines 20 of FIGS. 2 and 3 can be defined by a plurality of parameters, which will be discussed below.

The flow inlet edge 126 has a maximum inlet radius $R_{in}$ and the flow outlet edge 127 has a maximum outlet radius $R_{out}$. The outer contour 128 has an axial extent length $L_{axTip}$ with respect to the axis of rotation 123 or the rotor axis of rotation 15. The outer contour 128 has an axial length segment $L_{cover}$ of the axial extent $L_{axTip}$ in which the turbine blades 122 are axially covered by the turbine housing 21. In other words, this means the axial region in which a diameter of the turbine wheel 12 is greater than a smallest diameter DA of the turbine housing 21 at the turbine blade outlet 129 for the exhaust-gas mass flow AM. Furthermore, the housing contour 211 and the outer contour 128 are spaced from one another in such a way that a minimal gap is formed, wherein a smallest radial distance $Tip_{clr}$ exists between the housing contour 211 and the outer contour 128.

As mentioned in the introduction, in the case of turbochargers, damage may occur with various adverse consequences. On the basis of FIGS. 4 to 6, exemplary embodiments of turbines 20 will be described which, in the event of damage to the turbocharger 1, permit the functions and advantages stated in the introduction.

Figures 4, 5:
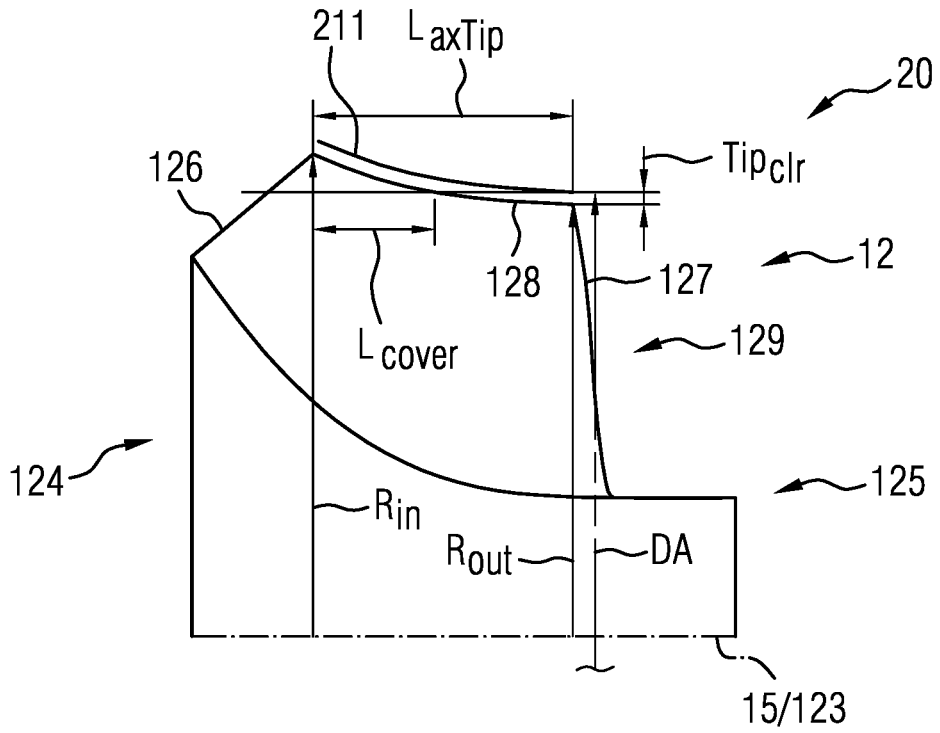
FIG. 4 shows a schematic sectional view of an exhaust-gas turbine of a turbocharger according to an exemplary embodiment.
FIG. 5 shows an equation for the design of the exhaust-gas turbine according to the exemplary embodiment.

FIG. 4 shows a turbine 20 which substantially corresponds to the turbines of FIGS. 2 and 3. The above parameter definitions apply analogously. By contrast to the described turbines of FIGS. 2 and 3, the turbine 20 is designed such that the equation shown in FIG. 5 is satisfied. The condition is as follows:

$$\frac{L_{cover}}{L_{axTip}} > 1 - \frac{Tip_{cir}}{R_{in}} \times \frac{3\pi}{4} \times \frac{1}{\left(1 - \frac{R_{out}}{R_{in}}\right)}.$$

The advantages and functions stated in the introduction are thus achieved. It is pointed out at this juncture that the ratio $R_{out}$ to $R_{in}$ can be referred to as trim (see FIG. 5).

The design and production of the turbine 20 are performed for example in such a way that certain parameters are predefined and remaining parameters are ascertained by means of the conditions in order to obtain a required minimum value for $L_{cover}$.

It is advantageous, as can also be seen in FIG. 4 by contrast to the examples of FIGS. 2 and 3, that the axial length segment $L_{cover}$ has been increased and adapted to the turbine housing 21. As a result, the turbine wheel 12 has an enlarged segment which is covered by the turbine housing 21.

Figure 6:
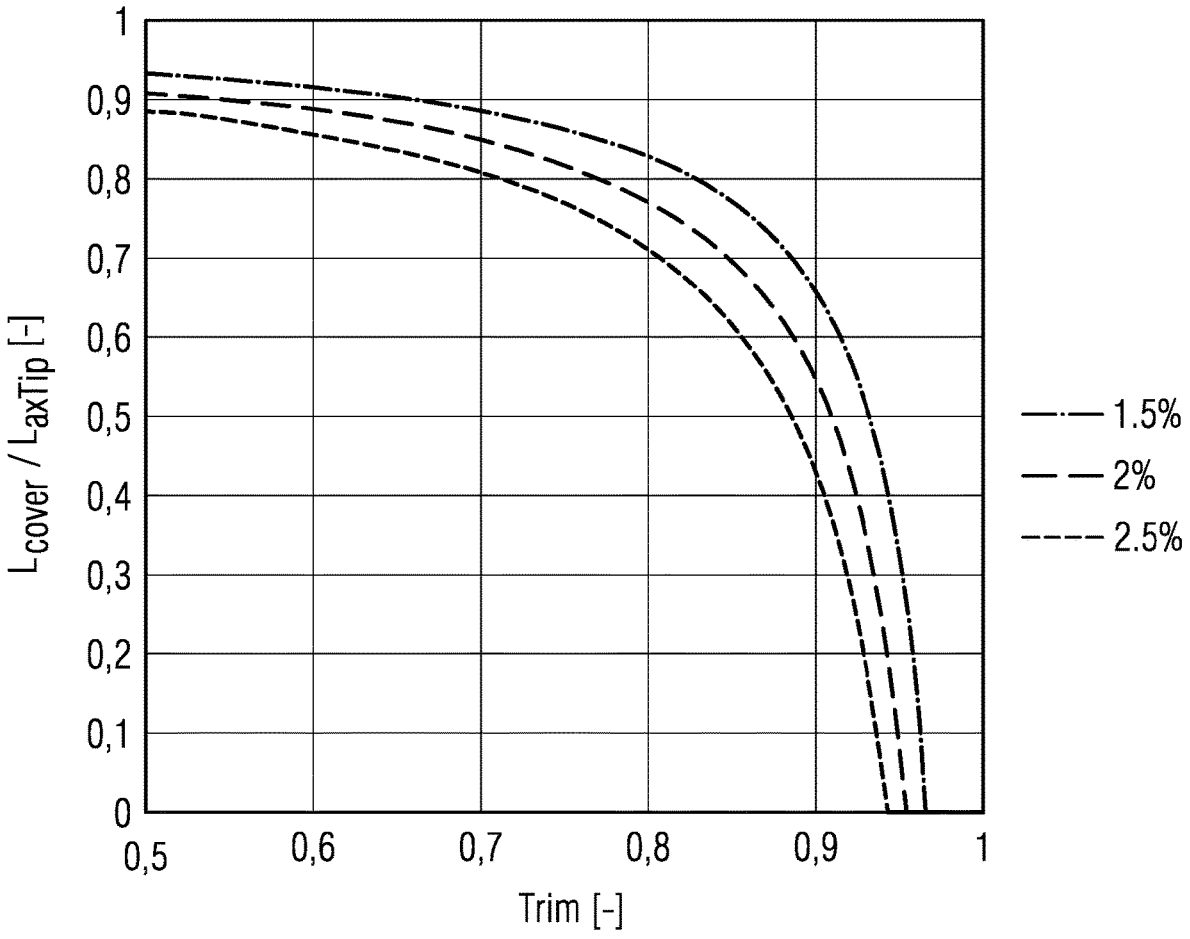
FIG. 6 shows a diagrammatic illustration of the equation of FIG. 5 with three exemplary parameter selections.

FIG. 6 shows a diagram in which the trim value is plotted on the X axis and the ratio of $L_{cover}$ to $L_{axTip}$ is plotted on the Y axis. By way of example, three curves of the equation according to FIG. 5 are shown, which differ by the percentage values shown to the right of the diagram, which result from the ratio of $Tip_{clr}$ to $R_{in}$.

The example embodiments have been described herein in an illustrative manner, and it is to be understood that the terminology which has been used is intended to be in the nature of words of description rather than of limitation. Obviously, many modifications and variations of the invention are possible in light of the above teachings. The description above is merely exemplary in nature and, thus, variations may be made thereto without departing from the spirit and scope of the invention as defined in the appended claims.

The invention claimed is:

1. A turbocharger for a combustion machine, comprising:

a bearing housing, in which a rotor shaft is mounted so as to be rotatable about a rotor axis of rotation; and an exhaust-gas turbine with a turbine wheel which is arranged rotationally conjointly on the rotor shaft and which has an impeller blade arrangement with multiple turbine blades, and with a turbine housing which is mechanically fixed to the bearing housing and which surrounds the turbine wheel;

wherein, with respect to a meridional view, the exhaust-gas turbine includes at least one turbine blade of the turbine wheel has a flow inlet edge and a flow outlet edge for exhaust-gas mass flow, the flow inlet edge has a maximum inlet radius $R_{in}$ and the flow outlet edge has a maximum outlet radius $R_{out}$, in each case with respect to the rotor axis of rotation;

the at least one turbine blade has an outer contour which faces toward the turbine housing and which extends from the flow inlet edge to the flow outlet edge and which has an axial extent length $L_{axTip}$;

the turbine housing has a housing contour which is situated opposite the outer contour;

the outer contour of the at least one turbine blade has an axial length segment $L_{cover}$ of the axial extent length $L_{axTip}$ in which the at least one turbine blade is axially covered by the turbine housing; and a smallest radial distance $Tip_{clr}$ with respect to the rotor axis of rotation is formed between the housing contour and the outer contour;

and wherein the turbine housing and the turbine wheel are configured relative to one another such that the following condition is satisfied:

$$\frac{L_{cover}}{L_{axTip}} > 1 - \frac{Tip_{cir}}{R_{in}} \times \frac{3\pi}{4} \times \frac{1}{\left(1 - \frac{R_{out}}{R_{in}}\right)}.$$

2. The turbocharger as claimed in claim 1, wherein, for the ratio $Tip_{clr}$ to $R_{in}$, the following applies:

$$\frac{Tip_{cir}}{R_{in}} \leq 2.5\%.$$

3. The turbocharger as claimed in claim 1, wherein, for the ratio $Tip_{clr}$ to $R_{in}$, the following applies:

$$\frac{Tip_{cir}}{R_{in}} \leq 2.0\%.$$

4. The turbocharger as claimed in claim 1, wherein, for the ratio $Tip_{clr}$ to $R_{in}$, the following applies:

$$\frac{Tip_{cir}}{R_{in}} \leq 1.5\%.$$

5. The turbocharger as claimed in claim 1, wherein, for the ratio $L_{cover}$ to $L_{axtip}$, the following applies:

$$\frac{L_{cover}}{L_{axTip}} > 0.2.$$

6. The turbocharger as claimed in claim 1, wherein, for the ratio $L_{cover}$ to $L_{axtip}$, the following applies:

$$\frac{L_{cover}}{L_{axTip}} > 0.25.$$

7. The turbocharger as claimed in claim 1, wherein, for the ratio $L_{cover}$ to $L_{axtip}$, the following applies:

$$\frac{L_{cover}}{L_{axTip}} > 0.3.$$

8. The turbocharger as claimed in claim 1, wherein, for the ratio $R_{out}$ to $R_{in}$, the following applies:

$$0.8 < \frac{R_{out}}{R_{in}} < 0.95.$$

9. The turbocharger as claimed in claim 1, wherein for the ratio $R_{out}$ to $R_{in}$, $$\frac{Rout}{Rin} > 0.8.$$

10. The turbocharger as claimed in claim 1, wherein for the ratio $R_{out}$ to $R_{in}$, $$\frac{Rout}{Rin} < 0.95.$$

11. A method for producing a turbocharger as claimed in claim 1, comprising:

determining parameters of the maximum inlet radius $R_{in}$, the maximum outlet radius $R_{out}$, the axial extent length $L_{axTip}$, the axial length segment $L_{cover}$ and the smallest radial distance $Tip_{clr}$, such that, for the turbine wheel and the turbine housing, the following condition is satisfied $$\frac{L_{cover}}{L_{axTip}} > 1 - \frac{Tip_{cir}}{R_{in}} \times \frac{3\pi}{4} \times \frac{1}{\left(1 - \frac{R_{out}}{R_{in}}\right)};$$

and manufacturing the turbine wheel and the turbine housing on the basis of the parameters ascertained based upon the condition.

12. A turbine wheel for an exhaust-gas turbocharger having an impeller blade arrangement with multiple turbine blades, wherein the turbine wheel is configured such that the following condition is satisfied:

$$\frac{L_{cover}}{L_{axTip}} > 1 - \frac{Tip_{cir}}{R_{in}} \times \frac{3\pi}{4} \times \frac{1}{\left(1 - \frac{R_{out}}{R_{in}}\right)}$$

wherein, with respect to a meridional view of the turbine wheel, at least one turbine blade of the turbine wheel has a flow inlet edge and a flow outlet edge for exhaust-gas mass flow;

$R_{in}$ describes a maximum inlet radius of the flow inlet edge and $R_{out}$ describes a maximum outlet radius of the flow outlet edge, in each case with respect to an axis of rotation of the turbine wheel;

$L_{axTip}$ describes an axial extent length of an outer contour of the at least one turbine blade, wherein the outer contour extends from the flow inlet edge to the flow outlet edge and, during intended operation, faces toward a surrounding turbine housing;

$L_{cover}$ describes an axial length segment of the axial extent $L_{axTip}$ of the outer contour in which the at least one turbine blade is axially covered by the turbine housing; and $Tip_{clr}$ describes a smallest radial distance between a housing contour, which during intended operation is situated opposite the outer contour, of the turbine housing and the outer contour with respect to the axis of rotation.

13. The turbine wheel of claim 12, wherein, the ratio $Tip_{clr}$ to $R_{in}$ is less than or equal to 2.5%.

14. The turbine wheel of claim 12, wherein, the ratio $Tip_{clr}$ to $R_{in}$ is less than or equal to 2.0%.

15. The turbine wheel of claim 12, wherein, the ratio $Tip_{clr}$ to $R_{in}$ is less than or equal to 1.5%.

16. The turbine wheel of claim 12, wherein the ratio $L_{cover}$ to $L_{axtip}$ is greater than one of 0.2.

17. The turbine wheel of claim 12, wherein the ratio $L_{cover}$ to $L_{axtip}$ is greater than one of 0.25.

18. The turbine wheel of claim 12, wherein the ratio $L_{cover}$ to $L_{axtip}$ is greater than one of 0.3.

19. The turbine of claim 12, wherein the ratio $R_{out}$ to $R_{in}$ is greater than 0.8 and less than 0.95.

* * * * *